US012553674B2

(12) United States Patent
Yuan et al.

(10) Patent No.: US 12,553,674 B2
(45) Date of Patent: Feb. 17, 2026

(54) MANIFOLD ASSEMBLY AND HEAT EXCHANGER

(71) Applicant: Danfoss A/S, Nordborg (DK)

(72) Inventors: Jing Yuan, Zhejiang (CN); Feng Zhang, Zhejiang (CN); Yubao Liu, Zhejiang (CN); Xuemei Yang, Zhejiang (CN)

(73) Assignee: DANFOSS A/S, Nordborg (DK)

( * ) Notice: Subject to any disclaimer, the term of this patent is extended or adjusted under 35 U.S.C. 154(b) by 139 days.

(21) Appl. No.: 18/264,195

(22) PCT Filed: Dec. 23, 2021

(86) PCT No.: PCT/CN2021/140784
§ 371 (c)(1),
(2) Date: Aug. 3, 2023

(87) PCT Pub. No.: WO2022/166454
PCT Pub. Date: Aug. 11, 2022

(65) Prior Publication Data

US 2024/0102747 A1 Mar. 28, 2024

(30) Foreign Application Priority Data

Feb. 5, 2021 (CN) ..... 202120340418.2

(51) Int. Cl.
*F28F 9/02* (2006.01)

(52) U.S. Cl.
CPC ..... *F28F 9/0246* (2013.01); *F28F 9/0265* (2013.01)

(58) Field of Classification Search
CPC ..... F28F 9/0265; F28F 9/027; F28F 9/0273; F25B 39/028
See application file for complete search history.

(56) References Cited

U.S. PATENT DOCUMENTS 5,186,249 A 2/1993 Bhatti et al.
5,280,971 A * 1/1994 Tokutake ..... F28D 1/05366 285/289.2

(Continued)

FOREIGN PATENT DOCUMENTS

CN 201637328 U 11/2010
CN 102269486 A 12/2011

(Continued)

OTHER PUBLICATIONS

European Search Report for corresponding European Patent Application No. EP 21 92 4447 dated Dec. 4, 2024.

(Continued)

*Primary Examiner* — Eric S Ruppert
(74) *Attorney, Agent, or Firm* — McCormick, Paulding & Huber PLLC

(57) ABSTRACT

Disclosed in the present invention are a manifold assembly and a heat exchanger. The manifold assembly includes a manifold and a connecting tube assembly. The connecting tube assembly includes an adapter and a steering member. The adapter includes: a tubular part located outside the manifold; and a step part protruding inward from the inner surface of the tubular part at the end portion of the tubular part facing the manifold. The steering member includes: an end wall, a connecting wall extending from the end wall along a direction intersecting the axial direction of the manifold, and a step part protruding outward from the connecting wall at the end portion of the connecting wall away from the end wall. The steering member is inserted into a through hole of the manifold by means of an inner hole of the adapter; the side of the step part of the steering member facing the end wall abuts against the step part of the adapter; and the part of the connecting wall inserted into the manifold is provided with openings that penetrate through the connecting wall. According to the manifold assembly of (Continued)

the present invention, direct impact of a fluid from an inlet on a flat tube is avoided, and the manufacturing and assembly processes are simple and the costs are low.

13 Claims, 6 Drawing Sheets

(56) References Cited

U.S. PATENT DOCUMENTS

| | | | |
|---|---|---|---|
| 5,465,783 | A | 11/1995 | O'Connor |
| 5,593,187 | A | 1/1997 | Okuda et al. |
| 2008/0190134 | A1 | 8/2008 | Khatib et al. |
| 2016/0356558 | A1 | 12/2016 | Franz et al. |

FOREIGN PATENT DOCUMENTS

| | | | | | |
|---|---|---|---|---|---|
| CN | 202813895 | U | | 3/2013 | |
| CN | 203100291 | U | * | 7/2013 | |
| CN | 104006576 | A | | 8/2014 | |
| CN | 205747594 | U | | 11/2016 | |
| CN | 205784041 | U | * | 12/2016 | |
| CN | 205980911 | U | | 2/2017 | |
| CN | 208012448 | U | | 10/2018 | |
| CN | 208419675 | U | | 1/2019 | |
| CN | 208794785 | U | | 4/2019 | |
| CN | 215261367 | U | | 12/2021 | |
| JP | 08200885 | A | | 8/1996 | |
| JP | H10-89885 | A | | 4/1998 | |
| JP | 2000002497 | A | * | 1/2000 | ..... F28F 9/0265 |
| JP | 2001-12892 | A | | 1/2001 | |
| JP | 2016183847 | A | | 10/2016 | |
| KR | 101991945 | B1 | | 6/2017 | |
| TW | 302063 | U | | 4/1997 | |

OTHER PUBLICATIONS

International Search Report dated Feb. 18, 2022, in connection with corresponding International Application No. PCT/CN2021/140784 (7 pp., including machine-generated English translation).

* cited by examiner

MANIFOLD ASSEMBLY AND HEAT EXCHANGER

CROSS-REFERENCE TO RELATED APPLICATIONS

This application is a National Stage application of International Patent Application No. PCT/CN2021/140784, filed on Dec. 23, 2021, which claims priority to Chinese Patent Application No. 202120340418.2, filed on Feb. 5, 2021, each of which is hereby in-corporated by reference in its entirety.

TECHNICAL FIELD

The present invention relates to a manifold assembly and a heat exchanger.

BACKGROUND

A heat exchanger comprises a manifold, flat tubes, and fins arranged alternately with the flat tubes.

SUMMARY

The objective of the present invention is to provide a manifold assembly and a heat exchanger comprising the manifold assembly, which can thus, for example, simplify the manufacturing and assembly process of the heat exchanger.

The present invention provides a manifold assembly, comprising: a manifold, the manifold comprising a manifold wall, and the manifold wall being provided with a through hole penetrating the manifold wall; and a connecting tube assembly, the connecting tube assembly comprising: an adapter, the adapter comprising: a tubular part which extends in a direction intersecting with an axial direction of the manifold and is located outside of the manifold; and a stepped part which protrudes inward from an inner surface of the tubular part at an end part of the tubular part facing the manifold; and a diverter, the diverter comprising: an end wall; a connecting wall extending from the end wall in a direction intersecting with an axial direction of the manifold; and a stepped part which protrudes outward from the connecting wall at an end part of the connecting wall away from the end wall, wherein the diverter is inserted into the through hole of the manifold through an inner hole of the adapter, the stepped part of the diverter abuts against the stepped part of the adapter on one side facing the end wall, and a portion of the connecting wall that is inserted into the manifold is provided with an opening penetrating the connecting wall.

According to an embodiment of the present invention, the connecting wall of the diverter is a tubular wall, and the opening of the connecting wall is a plurality of openings penetrating the tubular wall.

According to an embodiment of the present invention, viewing from a thickness direction of the end wall of the diverter, the connecting wall extends along a portion of a periphery of the end wall, and the connecting wall comprises one portion or a plurality of separated portions.

According to an embodiment of the present invention, viewing from the thickness direction of the end wall of the diverter, the connecting wall is two separated portions that extend along the periphery of the end wall and face each other.

According to an embodiment of the present invention, the periphery of the end wall is provided with two segments of the connecting wall that extend along two arc segments of the same circle.

According to an embodiment of the present invention, the end wall of the diverter has a circular shape, and viewing from the thickness direction of the end wall of the diverter, the connecting wall is two separated portions that extend along the periphery of the end wall and face each other.

According to an embodiment of the present invention, the end wall of the diverter has a circular shape, and viewing from the thickness direction of the end wall of the diverter, the connecting wall is a portion that extends along a portion of the periphery of the end wall.

According to an embodiment of the present invention, the adapter further comprises a connecting part extending from at least one of the end part of the tubular part facing the manifold and the stepped part of the adapter to the through hole of the manifold, and the connecting part of the adapter is connected to an inner wall of the through hole of the manifold.

According to an embodiment of the present invention, the adapter further comprises a flange extending outward from the end part of the tubular part facing the manifold.

According to an embodiment of the present invention, the flange of the adapter is provided with a recess on a side facing the manifold, and a portion of the manifold is fitted into the recess of the adapter to connect the flange of the adapter to the manifold.

According to an embodiment of the present invention, the manifold assembly further comprises: a connecting tube, one end of the connecting tube being inserted into the tubular part of the adapter and abutting against the diverter.

According to an embodiment of the present invention, the connecting tube abuts against at least one of the end part of the connecting wall of the diverter that is away from the end wall and the stepped part of the diverter.

The present invention further provides a heat exchanger, comprising: a manifold assembly as stated above.

The manifold assembly and the heat exchanger according to an embodiment of the present invention can be used to, for example, simplify the manufacturing and assembly process of the heat exchanger.

DETAILED DESCRIPTION

Figure 1:
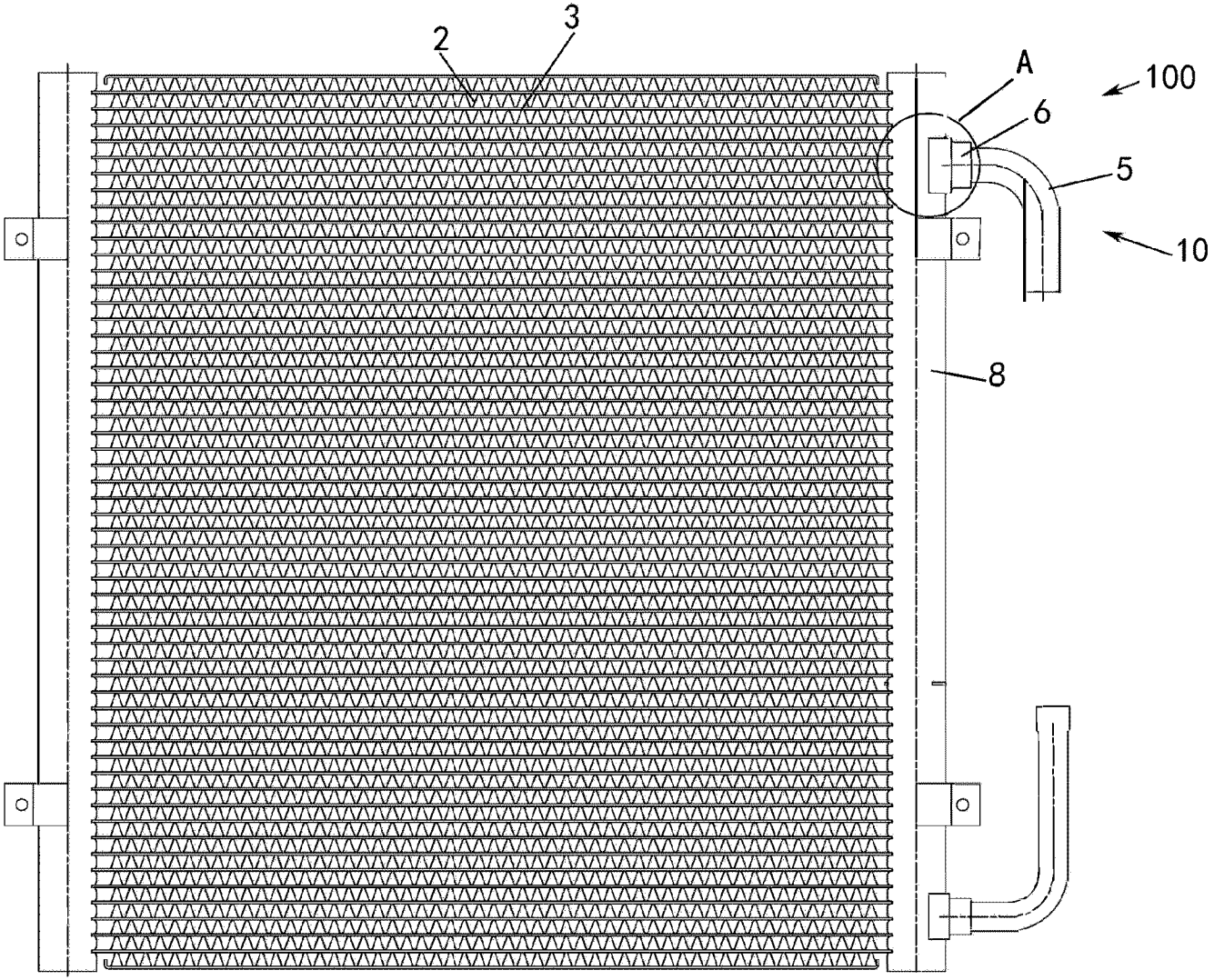
FIG. 1 is a schematic front view of a heat exchanger according to an embodiment of the present invention.

The present invention will be further described below in conjunction with accompanying drawings and particular embodiments.

Referring to FIG. 1 to FIG. 6C, a heat exchanger 100 according to an embodiment of the present invention comprises a manifold 8, a connecting tube 5, an adapter 6, a diverter 7, heat exchange tubes 3 and fins 2. The connecting tube 5, the adapter 6, and the diverter 7 form a connecting tube assembly; and the manifold 8, the connecting tube 5, the adapter 6, and the diverter 7 form a manifold assembly 10. The diverter 7 is configured to prevent a fluid that enters the heat exchanger 100 from directly impacting heat exchange tubes such as flat tubes. This avoids leakage or failure of the heat exchange tubes that is caused by the impact.

The manifold assembly 10 according to an embodiment of the present invention is described in detail below.

Referring to FIG. 2 to FIG. 6C, the manifold assembly 10 according to an embodiment of the present invention comprises a manifold 8 and a connecting tube assembly. The manifold 8 comprises a manifold wall 80, the manifold wall 80 being provided with a through hole 81 penetrating the manifold wall 80. The connecting tube assembly comprises: an adapter 6 and a diverter 7. The adapter 6 comprises: a tubular part 61 which extends in a direction intersecting with an axial direction of the manifold 8 and is located outside of the manifold 8; and a stepped part 63 which protrudes inward from an inner surface of the tubular part 61 at an end part 62 of the tubular part 61 facing the manifold 8. The diverter 7 comprises: an end wall 70; a connecting wall 71 extending from the end wall 70 in a direction intersecting with an axial direction of the manifold 8; and a stepped part 73 which protrudes outward from the connecting wall 71 at an end part 72 of the connecting wall 71 away from the end wall 70, wherein the diverter 7 is inserted into the through hole 81 of the manifold 8 through an inner hole of the adapter 6, the stepped part 73 of the diverter 7 abuts against the stepped part 63 of the adapter 6 on one side facing the end wall 70, and a portion of the connecting wall 71 that is inserted into the manifold 8 is provided with an opening 75 penetrating the connecting wall 71.

Figure 2:
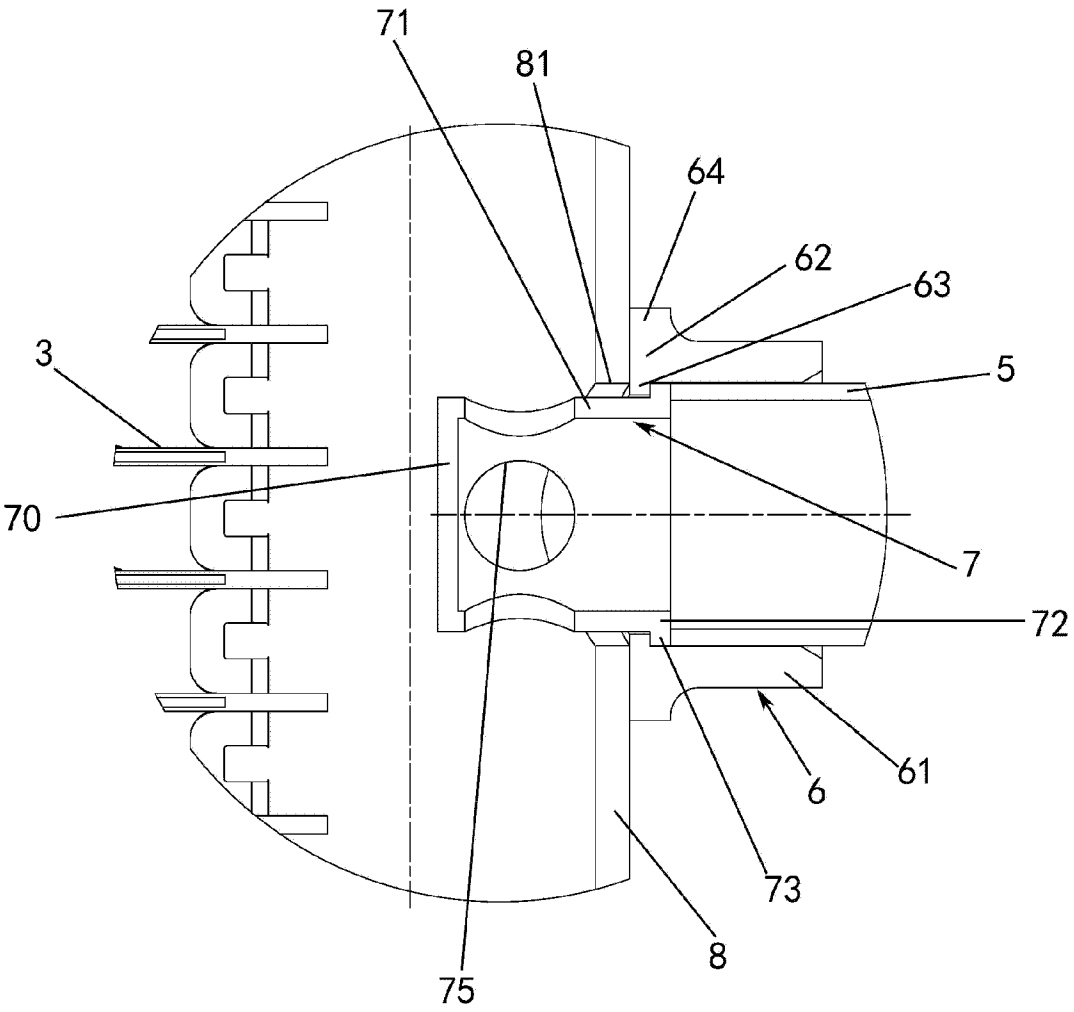
FIG. 2 is a sectional view of portion A of the heat exchanger shown in FIG. 1 according to an embodiment of the present invention.
Figure 3C:
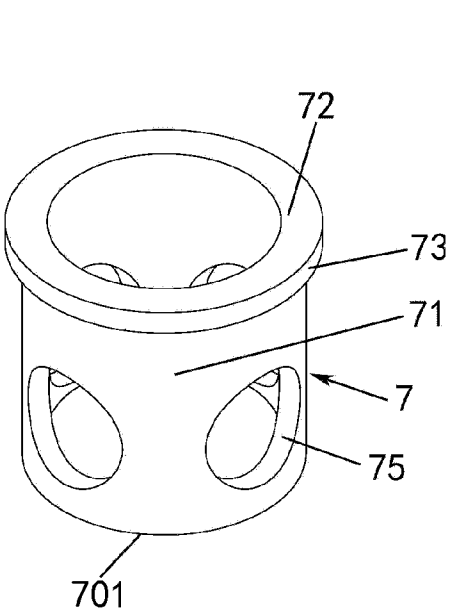
FIG. 3C is a perspective view of a diverter of a manifold assembly of a heat exchanger according to an embodiment of the present invention.
Figure 3B:
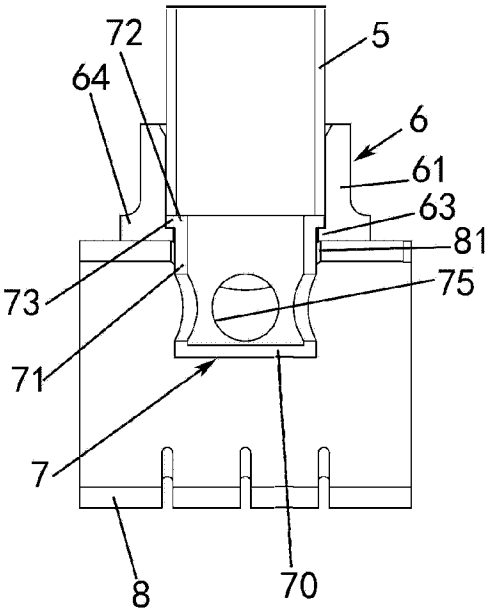
FIG. 3B is a sectional view of a manifold assembly of a heat exchanger according to an embodiment of the present invention.
Figure 3A:
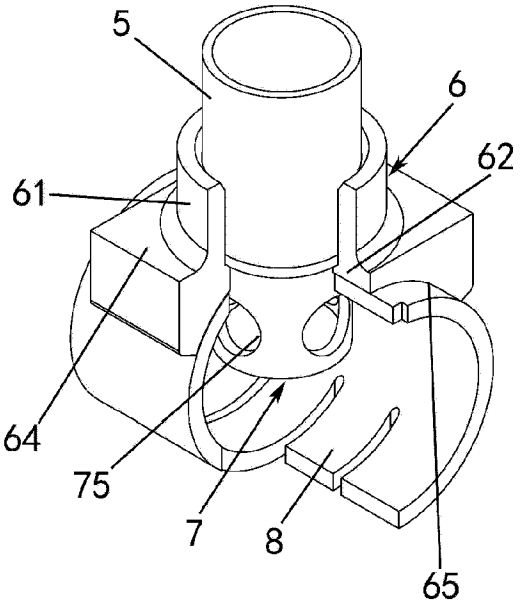
FIG. 3A is a perspective view of a manifold assembly of a heat exchanger according to an embodiment of the present invention.
Figure 4C:
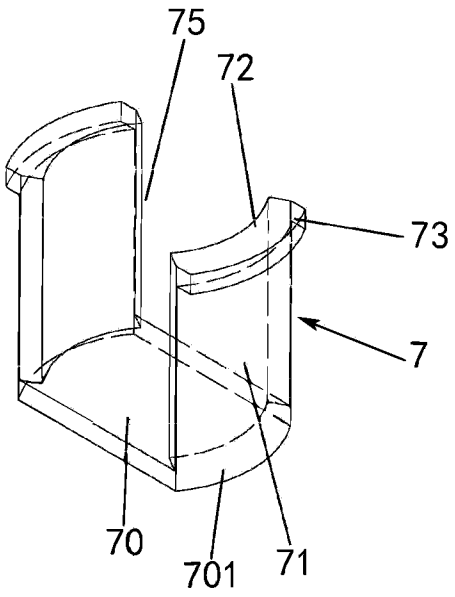
FIG. 4C is a perspective view of a diverter of a manifold assembly of a heat exchanger according to another embodiment of the present invention.
Figure 4B:
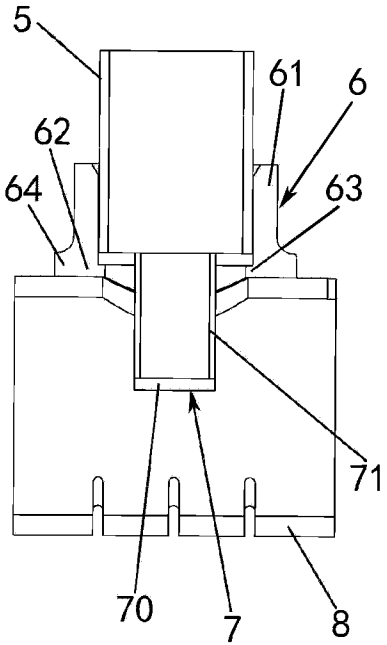
FIG. 4B is a sectional view of a manifold assembly of a heat exchanger according to another embodiment of the present invention.
Figure 4A:
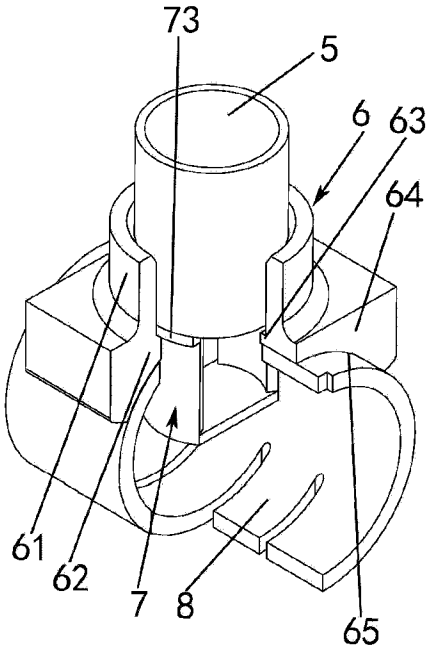
FIG. 4A is a perspective view of a manifold assembly of a heat exchanger according to another embodiment of the present invention.

Referring to FIG. 2 to FIG. 3C, in an embodiment of the present invention, the connecting wall 71 of the diverter 7 is a tubular wall, and the opening 75 of the connecting wall 71 is a plurality of openings 75 penetrating the tubular wall.

Referring to FIG. 4A to FIG. 6C, in an embodiment of the present invention, viewing from a thickness direction of the end wall 70 of the diverter 7, the connecting wall 71 extends along a portion of a periphery 701 of the end wall 70, and the connecting wall 71 comprises one portion or a plurality of separated portions.

Referring to FIG. 4A to FIG. 5C, in an embodiment of the present invention, viewing from the thickness direction of the end wall 70 of the diverter 7, the connecting wall 71 is two separated portions that extend along the periphery 701 of the end wall 70 and face each other. For example, referring to FIG. 4A to FIG. 4C, viewing from the thickness direction of the end wall 70 of the diverter 7, the connecting wall 71 and the end wall 70 have the same size in a direction perpendicular to the direction (from one of the two portions to the other) where the two portions face each other. For example, the connecting wall 71 and the end wall 70 have the same width. The periphery 701 of the end wall 70 is provided with two segments of the connecting wall 71 that can extend along two arc segments of the same circle.

Figure 5C:
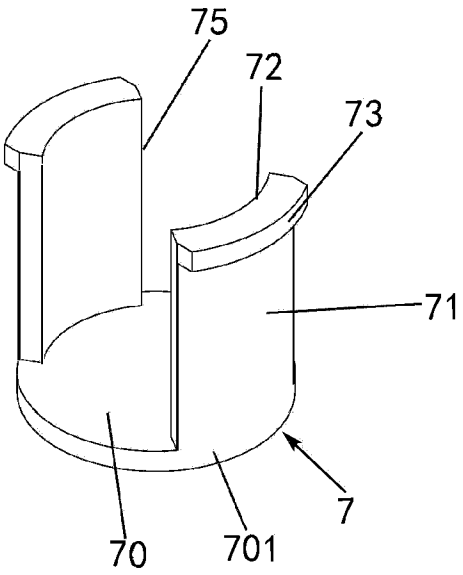
FIG. 5C is a perspective view of a diverter of a manifold assembly of a heat exchanger according to a further embodiment of the present invention.
Figure 5B:
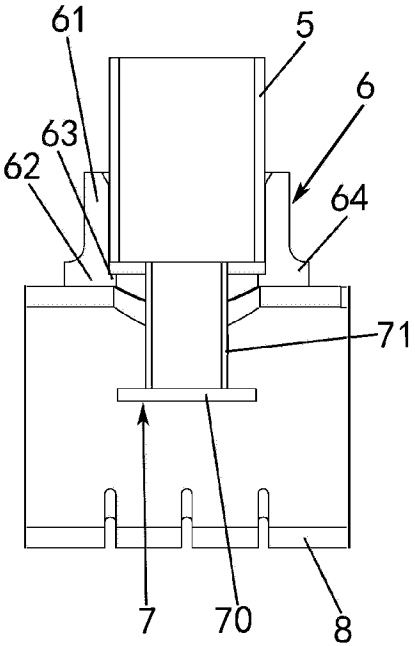
FIG. 5B is a sectional view of a manifold assembly of a heat exchanger according to a further embodiment of the present invention.
Figure 5A:
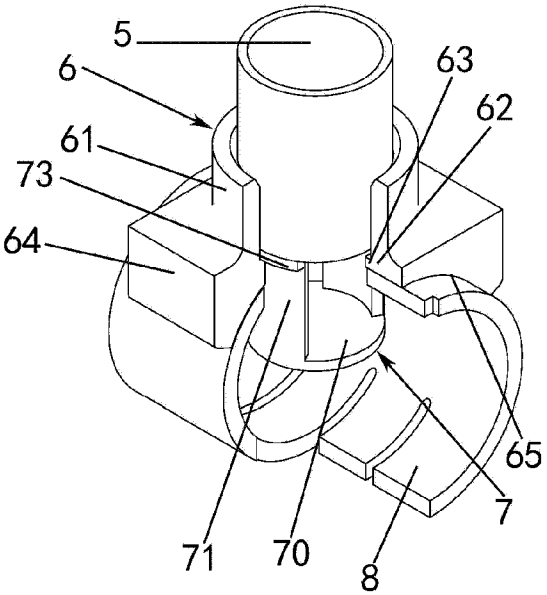
FIG. 5A is a perspective view of a manifold assembly of a heat exchanger according to a further embodiment of the present invention.

Referring to FIG. 5A to FIG. 5C, in an embodiment of the present invention, the end wall 70 of the diverter 7 has a circular shape, and viewing from the thickness direction of the end wall 70 of the diverter 7, the connecting wall 71 is two separated portions that extend along the periphery 701 of the end wall 70 and face each other.

Figure 6C:
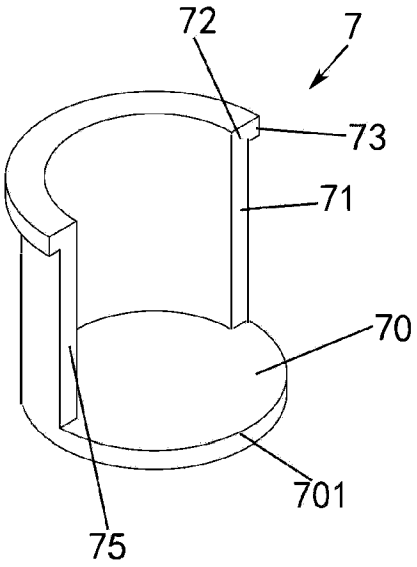
FIG. 6C is a perspective view of a diverter of a manifold assembly of a heat exchanger according to a still further embodiment of the present invention.
Figure 6B:
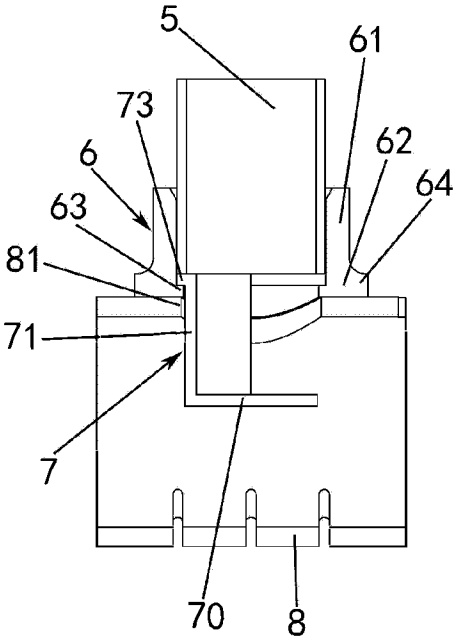
FIG. 6B is a sectional view of a manifold assembly of a heat exchanger according to a still further embodiment of the present invention.
Figure 6A:
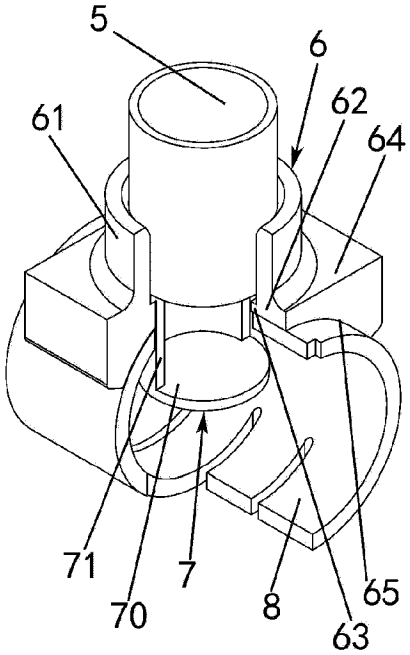
FIG. 6A is a perspective view of a manifold assembly of a heat exchanger according to a still further embodiment of the present invention.

Referring to FIG. 6A to FIG. 6C, in an embodiment of the present invention, the end wall 70 of the diverter 7 has a circular shape, and viewing from the thickness direction of the end wall 70 of the diverter 7, the connecting wall 71 is a portion that extends along a portion of the periphery 701 of the end wall 70.

Referring to FIG. 2 to FIG. 6C, in an embodiment of the present invention, the adapter 6 further comprises a connecting part extending from at least one of the end part 62 of the tubular part 61 facing the manifold 8 and the stepped part 63 of the adapter 6 to the through hole 81 of the manifold 8, and the connecting part of the adapter 6 is connected to an inner wall of the through hole 81 of the manifold 8.

Referring to FIG. 2 to FIG. 6C, in an embodiment of the present invention, the adapter 6 further comprises a flange 64 extending outward from the end part 62 of the tubular part 61 facing the manifold 8. According to an example of the present invention, the flange 64 of the adapter 6 is provided with a recess 65 on a side facing the manifold 8, and a portion of the manifold 8 is fitted into the recess 65 of the adapter 6 to connect the flange 64 of the adapter 6 to the manifold 8.

Referring to FIG. 2 to FIG. 6C, in an embodiment of the present invention, the manifold assembly 10 further comprises: a connecting tube 5, one end of the connecting tube 5 being inserted into the tubular part 61 of the adapter 6 and abutting against the diverter 7.

In an embodiment of the present invention, the stepped part 73 of the diverter 7 is clamped between the stepped part 63 of the adapter 6 and the connecting tube 5 so as to fix the diverter 7. The diverter 7 can be welded or not welded to the adapter 6. A gap exists between the connecting tube 5 and the tubular part 61 of the adapter 6 and is configured to be filled with a welding material. The connecting tube 5 abuts against the diverter 7. For example, the connecting tube 5 abuts against at least one of the end part 72 of the connecting wall 71 of the diverter 7 that is away from the end wall 70 and the stepped part 73 of the diverter 7.

The manifold assembly 10 and the heat exchanger 100 according to an embodiment of the present invention can be used to prevent the heat exchange tubes such as flat tubes near an inlet of the heat exchanger from being directly impacted by the fluid. This avoids leakage or failure of the heat exchange tubes that is caused by the impact. In addition, the diverter 7 can also serve to distribute a refrigerant. In the present invention, the connecting tube assembly uses a split structure, which is simple to manufacture and assemble, and has low costs.

Although the above embodiments have been described, some features of the above embodiments can be combined to form a new embodiment.

What is claimed is:

1. A manifold assembly, comprising:

a manifold, the manifold comprising a manifold wall, and the manifold wall being provided with a through hole penetrating the manifold wall; and a connecting tube assembly, the connecting tube assembly comprising:

an adapter, the adapter comprising: a tubular part which extends in a direction intersecting with an axial direction of the manifold and is located outside of the manifold; and a stepped part which protrudes inward from an inner surface of the tubular part at an end part of the tubular part facing the manifold; and a diverter, the diverter comprising: an end wall; a connecting wall extending from the end wall in a direction intersecting with an axial direction of the manifold; and a stepped part which protrudes outward from the connecting wall at an end part of the connecting wall away from the end wall, wherein the diverter is inserted into the through hole of the manifold through an inner hole of the adapter, the stepped part of the diverter abuts against the stepped part of the adapter on one side facing the end wall, and a portion of the connecting wall that is inserted into the manifold is provided with an opening penetrating the connecting wall, a connecting tube, one end of the connecting tube being inserted into the tubular part of the adapter and abutting against the diverter, wherein the connecting tube abuts against at least one of the end part of the connecting wall of the diverter that is away from the end wall and the stepped part of the diverter, further comprising a connecting tube, one end of the connecting tube being inserted into the tubular part of the adapter and abutting against the diverter, and wherein the diverter is clamped between the connecting tube and the stepped part of the adapter.

2. The manifold assembly as claimed in claim 1, wherein:

the connecting wall of the diverter is a tubular wall, and the opening of the connecting wall is a plurality of openings penetrating the tubular wall.

3. The manifold assembly as claimed in claim 1, wherein:

viewing from a thickness direction of the end wall of the diverter, the connecting wall extends along a portion of a periphery of the end wall, and the connecting wall comprises one portion or a plurality of separated portions.

4. The manifold assembly as claimed in claim 3, wherein:

viewing from the thickness direction of the end wall of the diverter, the connecting wall is two separated portions that extend along the periphery of the end wall and face each other.

5. The manifold assembly as claimed in claim 4, wherein:

the periphery of the end wall is provided with two segments of the connecting wall that extend along two arc segments of the same circle.

6. The manifold assembly as claimed in claim 3, wherein:

the end wall of the diverter has a circular shape, and viewing from the thickness direction of the end wall of the diverter, the connecting wall is two separated portions that extend along the periphery of the end wall and face each other.

7. The manifold assembly as claimed in claim 3, wherein:

the end wall of the diverter has a circular shape, and viewing from the thickness direction of the end wall of the diverter, the connecting wall is a portion that extends along a portion of the periphery of the end wall.

8. The manifold assembly as claimed in claim 1, wherein:

the adapter extends to the through hole of the manifold, and the adapter is connected to an inner wall of the through hole of the manifold.

9. The manifold assembly as claimed in claim 8, wherein:

the adapter further comprises a flange extending outward from the end part of the tubular part facing the manifold.

10. The manifold assembly as claimed in claim 1, wherein:

the adapter further comprises a flange extending outward from the end part of the tubular part facing the manifold.

11. The manifold assembly as claimed in claim 10, wherein:

the flange of the adapter is provided with a recess on a side facing the manifold, and a portion of the manifold is fitted into the recess of the adapter to connect the flange of the adapter to the manifold.

12. The manifold assembly as claimed in claim 1, wherein:

the connecting tube abuts against at least one of the end part of the connecting wall of the diverter that is away from the end wall and the stepped part of the diverter.

13. A heat exchanger, comprising:

a manifold assembly as claimed in claim 1.

* * * * *